US010697120B2

(12) United States Patent
Ruthven et al.

(10) Patent No.: US 10,697,120 B2
(45) Date of Patent: Jun. 30, 2020

(54) METHODS OF MAKING PAPER PRODUCTS USING A PATTERNED CYLINDER

(71) Applicant: GPCP IP Holdings LLC, Atlanta, GA (US)

(72) Inventors: Paul J. Ruthven, Neenah, WI (US); Frank D. Harper, Neenah, WI (US); Mark L. Robinson, Kaukauna, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 64 days.

(21) Appl. No.: 16/023,451

(22) Filed: Jun. 29, 2018

(65) Prior Publication Data

US 2019/0048525 A1 Feb. 14, 2019

Related U.S. Application Data

(60) Provisional application No. 62/542,378, filed on Aug. 8, 2017.

(51) Int. Cl.

| | |
|---|---|
| ***D21F 2/00*** | (2006.01) |
| ***D21F 11/06*** | (2006.01) |
| ***B31F 1/12*** | (2006.01) |
| ***D21F 11/14*** | (2006.01) |
| ***D21F 9/00*** | (2006.01) |
| ***D21F 5/18*** | (2006.01) |
| ***D21F 11/00*** | (2006.01) |
| ***D21H 27/00*** | (2006.01) |
| ***D21H 27/02*** | (2006.01) |

(52) U.S. Cl.

CPC ..... *D21F 11/06* (2013.01); *B31F 1/12* (2013.01); *D21F 2/00* (2013.01); *D21F 5/181* (2013.01); *D21F 9/003* (2013.01); *D21F 11/006* (2013.01); *D21F 11/14* (2013.01); *D21H 27/002* (2013.01); *D21H 27/02* (2013.01)

(58) Field of Classification Search

USPC ..... 162/116

See application file for complete search history.

(56) References Cited

U.S. PATENT DOCUMENTS

| | | | |
|---|---|---|---|
| 3,104,197 | A | 9/1963 | Back et al. |
| 4,608,108 | A | 8/1986 | Goll |
| 4,698,257 | A | 10/1987 | Goll |
| 5,411,636 | A | 5/1995 | Hermans et al. |
| 5,492,598 | A | 2/1996 | Hermans et al. |
| 5,505,818 | A | 4/1996 | Hermans et al. |
| 5,510,001 | A | 4/1996 | Hermans et al. |
| 5,510,002 | A | 4/1996 | Hermans et al. |
| 5,704,101 | A | 1/1998 | Majors et al. |
| 6,161,303 | A | 12/2000 | Beck |
| 6,248,210 | B1 | 6/2001 | Edwards et al. |
| 6,416,631 | B1 | 7/2002 | Beck |
| 7,186,317 | B2 | 3/2007 | Beuther et al. |
| 7,399,378 | B2 | 7/2008 | Edwards et al. |
| 7,442,278 | B2 | 10/2008 | Murray et al. |
| 7,494,563 | B2 | 2/2009 | Edwards et al. |
| 7,662,257 | B2 | 2/2010 | Edwards et al. |
| 7,758,727 | B2 | 7/2010 | Beuther et al. |
| 7,789,995 | B2 | 9/2010 | Super et al. |
| 8,080,130 | B2 | 12/2011 | Harper et al. |
| 8,142,613 | B2 | 3/2012 | Biagiotti |
| 8,142,614 | B2 * | 3/2012 | Biagiotti ..... D21F 11/006 156/219 |
| 8,293,072 | B2 | 10/2012 | Super et al. |
| 8,398,818 | B2 | 3/2013 | Edwards et al. |
| 8,425,730 | B2 | 4/2013 | Biagiotti |
| 8,597,469 | B2 | 12/2013 | Biagiotti |
| 9,279,219 | B2 | 3/2016 | Edwards et al. |
| 9,388,534 | B2 | 7/2016 | Super et al. |
| 2002/0100153 | A1 | 8/2002 | Takai et al. |
| 2004/0149405 | A1 | 8/2004 | Beck |
| 2005/0126728 | A1 | 6/2005 | Beuther et al. |
| 2005/0241787 | A1 | 11/2005 | Murray et al. |
| 2007/0151692 | A1 | 7/2007 | Beuther et al. |
| 2008/0308240 | A1 | 12/2008 | Biagiotti |
| 2009/0199986 | A1 | 8/2009 | Biagiotti |

(Continued)

FOREIGN PATENT DOCUMENTS

| | | | |
|---|---|---|---|
| CN | 1217642 | A | 5/1999 |
| CN | 101313108 | A | 11/2008 |

(Continued)

OTHER PUBLICATIONS

Biagiotti, CN 101313108, machine translation, Nov. 2008.*

International Search Report dated Sep. 25, 2018, issued in corresponding International Patent Application No. PCT/IB2018/055644.

Chinese PCT Collaborative Search and Examination Pilot Upload Peer Contribution uploaded Sep. 7, 2018, issued in corresponding International Patent Application No. PCT/IB2018/055644.

(Continued)

*Primary Examiner* — Mark Halpern

(74) *Attorney, Agent, or Firm* — Laura L. Bozek

(57) ABSTRACT

A method of making a fibrous sheet including bringing a permeable patterned surface of a patterned cylinder into contact with a nascent web and conveying the nascent web between a transfer surface and the permeable patterned surface over an arc length of the permeable patterned surface. The arc length forms at least a portion of a molding zone. The method also includes applying a vacuum over at least a portion of the arc length. The method further includes transferring the nascent web from the transfer surface to the permeable patterned surface of the patterned cylinder in the molding zone. The vacuum is applied during the transferring of the nascent web from the transfer surface to the permeable patterned surface of the patterned cylinder.

74 Claims, 7 Drawing Sheets

(56) References Cited

U.S. PATENT DOCUMENTS

| | | | |
|---|---|---|---|
| 2010/0186913 | A1 | 7/2010 | Super et al. |
| 2012/0152477 | A1 | 6/2012 | Biagiotti |
| 2012/0199300 | A1 | 8/2012 | Edwards et al. |
| 2012/0205063 | A1 | 8/2012 | Biagiotti |
| 2015/0068695 | A1 | 3/2015 | Edwards et al. |
| 2015/0152603 | A1 | 6/2015 | Super et al. |

FOREIGN PATENT DOCUMENTS

| | | | |
|---|---|---|---|
| CN | 104195865 | A | 12/2014 |
| EP | 0 108 381 | A1 | 5/1984 |
| EP | 0 625 610 | A1 | 11/1994 |
| EP | 1 541 755 | A1 | 6/2005 |
| GB | 903508 | A | 8/1962 |
| JP | 52-7306 | | 1/1977 |
| WO | 2005/106116 | A1 | 11/2005 |
| WO | 2017/139123 | A1 | 8/2017 |
| WO | 2017/139124 | A1 | 8/2017 |
| WO | 2017/139125 | A1 | 8/2017 |

OTHER PUBLICATIONS

Japanese PCT Collaborative Search and Examination Pilot Upload Peer Contribution uploaded Sep. 7, 2018, issued in corresponding International Patent Application No. PCT/IB2018/055644.

Korean PCT Collaborative Search and Examination Pilot Upload Peer Contribution uploaded Sep. 13, 2018, issued in corresponding International Patent Application No. PCT/IB2018/055644.

United States PCT Collaborative Search and Examination Pilot Upload Peer Contribution uploaded Sep. 5, 2018, issued in corresponding International Patent Application No. PCT/IB2018/055644.

* cited by examiner

METHODS OF MAKING PAPER PRODUCTS USING A PATTERNED CYLINDER

CROSS REFERENCE TO RELATED APPLICATION

This application is based on U.S. Provisional Patent Application No. 62/542,378, filed Aug. 8, 2017, which is incorporated herein in its entirety.

FIELD OF THE INVENTION

Our invention relates to methods and apparatuses for manufacturing paper products such as paper towels and bathroom tissue. In particular, our invention relates to methods that use a patterned cylinder to mold a paper web during formation of the paper product.

BACKGROUND OF THE INVENTION

Generally speaking, paper products are formed by depositing a furnish comprising an aqueous slurry of papermaking fibers onto a forming section to form a paper web, and then dewatering the web to form a paper product. Various methods and machinery are used to form the paper web and to dewater the web. In papermaking processes to make tissue and towel products, for example, there are many ways to remove water in the processes, each with substantial variability. As a result, the paper products likewise have a large variability in properties.

One such method of dewatering a paper web is known in the art as conventional wet pressing (CWP). FIG. 1 shows an example of a CWP papermaking machine 100. Papermaking machine 100 has a forming section 110, which, in this case, is referred to in the art as a crescent former. The forming section 110 includes headbox 112 that deposits an aqueous furnish between a forming fabric 114 and a papermaking felt 116, thereby initially forming a nascent web 102. The forming fabric 114 is supported by rolls 122, 124, 126, 128. The papermaking felt 116 is supported by a forming roll 120. The nascent web 102 is transferred by the papermaking felt 116 along a felt run 118 that extends to a press roll 132 where the nascent web 102 is deposited onto a Yankee dryer section 140 in a press nip 130. The nascent web 102 is wet-pressed in the press nip 130 concurrently with the transfer to the Yankee dryer section 140. As a result, the consistency of the web 102 is increased from about twenty percent solids just prior to the press nip 130 to between about thirty percent solids and about fifty percent solids just after the press nip 130. The Yankee dryer section 140 comprises, for example, a steam filled drum 142 ("Yankee drum") and hot air dryer hoods 144, 146 to further dry the web 102. The web 102 may be removed from the Yankee drum 142 by a doctor blade 152 where it is then wound on a reel (not shown) to form a parent roll 190.

A CWP papermaking machine, such as papermaking machine 100, typically has low drying costs, and can quickly produce the parent roll 190 at speeds from about three thousand feet per minute to in excess of five thousand feet per minute. Papermaking using CWP is a mature process that provides a papermaking machine having high runability and uptime. As a result of the compaction used to dewater the web 102 at the press nip 130, the resulting paper product typically has a low bulk with a corresponding high fiber cost. While this can result in rolled paper products, such as paper towels or toilet paper, having a high sheet count per roll, the paper products generally have a low absorbency and can feel rough to the touch.

As consumers often desire paper products that feel soft and have a high absorbance, other papermaking machines and methods have been developed. Through-air-drying (TAD) is one method that may result in paper products having these characteristics. FIG. 2 shows an example of a TAD papermaking machine 200. The forming section 230 of this papermaking machine 200 is shown with what is known in the art as a twin-wire forming section and it produces a sheet similar to that produced by the crescent former (forming section 110 of FIG. 1). As shown in FIG. 2, the furnish is initially supplied in the papermaking machine 200 through a headbox 202. The furnish is directed by the headbox 202 into a nip formed between a first forming fabric 204 and a second forming fabric 206, ahead of forming roll 208. The first forming fabric 204 and the second forming fabric 206 move in continuous loops and diverge after passing beyond forming roll 208. Vacuum elements such as vacuum boxes, or foil elements (not shown) can be employed in the divergent zone to both dewater the sheet and to ensure that the sheet stays adhered to second forming fabric 206. After separating from the first forming fabric 204, the second forming fabric 206 and web 102 pass through an additional dewatering zone 212 in which suction boxes 214 remove moisture from the web 102 and second forming fabric 206, thereby increasing the consistency of the web 102 from, for example, about ten percent solids to about twenty-eight percent solids. Hot air may also be used in dewatering zone 212 to improve dewatering. The web 102 is then transferred to a through-air drying (TAD) fabric 216 at transfer nip 218, where a shoe 220, for example, presses the TAD fabric 216 against the second forming fabric 206. In some TAD papermaking machines, the shoe 220 is a vacuum shoe that applies a vacuum to assist in the transfer of the web 102 to the TAD fabric 216. Additionally, so-called rush transfer maybe used to transfer the web 102 in transfer nip 218 as well as to structure the web 102. Rush transfer occurs when the second forming fabric 206 travels at a speed that is faster than the TAD fabric 216.

The fabric 216 carrying the paper web 102 next passes around through-air dryers 222, 224 where hot air is forced through the web to increase the consistency of the paper web 102, from about twenty-eight percent solids to about eighty percent solids. The web 102 is then transferred to the Yankee dryer section 140, where the web 102 is further dried. The sheet is then doctored off of the Yankee drum 142 by doctor blade 152 and is taken up by a reel (not shown) to form a parent roll (not shown). As a result of the minimal compaction during the drying process, the resulting paper product has a high bulk with corresponding low fiber cost. Unfortunately, this process is costly to operate because a lot of water is removed by expensive thermal drying. In addition, the papermaking fibers in a paper product made by TAD typically are not strongly bound, resulting in a paper product that can be weak.

Other methods have been developed to increase the bulk and softness of the paper product as compared to CWP, while still retaining strength in the paper web and having low drying costs as compared to TAD. These methods generally involve compactively dewatering the web and then belt creping the web so as to redistribute the web fibers in order to achieve desired properties. This method is referred to herein as belt creping and is described in, for example, U.S. Pat. No. 7,399,378, 7,442,278, 7,494,563, 7,662,257, and 7,789,995 (the disclosures of which are incorporated by reference herein in their entirety).

FIG. 3 shows an example of a papermaking machine 300 used for belt or fabric creping. Similar to the CWP papermaking machine 100, shown in FIG. 1, this papermaking machine 300 uses a crescent former, discussed above, as the forming section 110. After leaving the forming section 110, the felt run 118, which is supported on one end by roll 108, extends to a shoe press section 310. Here, the web 102 is transferred from the papermaking felt 116 to a backing roll 312 in a nip formed between the backing roll 312 and a shoe press roll 314. A shoe 316 is used to load the nip and to dewater the web 102 concurrently with the transfer.

The web 102 is then transferred onto a creping belt or fabric 322 in a creping nip 320 by the action of the creping nip 320. The creping nip 320 is defined between the backing roll 312 and the creping belt or fabric 322, with the creping belt or fabric 322 being pressed against the backing roll 312 by a creping roll 326. In the transfer at the creping nip 320, the cellulosic fibers of the web 102 are repositioned and oriented. The web 102 may tend to stick to the smoother surface of the backing roll 312 relative to the creping belt or fabric 322. Consequently, it may be desirable to apply release oils on the backing roll 312 to facilitate the transfer from the backing roll 312 to the creping belt 322. Also, the backing roll 312 may be a steam heated roll. After the web 102 is transferred onto the creping belt or fabric 322, a vacuum box 324 may be used to apply a vacuum to the web 102 in order to increase sheet caliper by pulling the web 102 into the topography of the creping belt or fabric 322.

It generally is desirable to perform a rush transfer of the web 102 from the backing roll 312 to the creping belt or fabric 322 in order to facilitate transfer of the web 102 to creping belt or fabric 322 and to further improve sheet bulk and softness. During a rush transfer, the creping belt or fabric 322 is traveling at a slower speed than is the web 102 on the backing roll 312. Among other things, rush transferring redistributes the paper web 102 on the creping belt or fabric 322 to impart structure to the paper web 102 in order to increase bulk and to enhance transfer to the creping belt or fabric 322.

After this creping operation, the web 102 is deposited on a Yankee drum 142 in the Yankee dryer section 140 in a low intensity press nip 328. As with the CWP papermaking machine 100 shown in FIG. 1, the web 102 is then dried in the Yankee dryer section 140 and then wound on a reel (not shown). While the creping belt 322 imparts desirable bulk and structure to the web 102, the creping belt 322 may be difficult to use. As the creping belt or fabric 322 moves through its travel, the belt bends and flexes, resulting in fatigue of the belt or fabric 322. Thus, the creping belt or fabric 322 is susceptible to fatigue failure. In addition, creping belts and fabrics 322 are custom designed elements with no other commercial analog. They are designed to impart a targeted structure to the paper web, and can be difficult to manufacture, since they are a low volume element and little prior commercial history exists. Additionally, the patterns and types of structures that can be imparted to the web 102 by a woven fabric 322 are limited because of constraints resulting from belt design and construction. Further, the speed of the papermaking machine 300 is slowed by the crepe ratio when the web 102 is rush transferred from the backing roll 312 to the creping belt or fabric 322. The slower exiting web speed leads to lower production speeds as compared to non-belt creped systems. Additionally, such creping belt runs require large amounts of floor space and thus increase the size and complexity of the papermaking machine 300. Furthermore, uniform, reliable sheet transfer to the creping belt or fabric 322 may be challenging to achieve. Accordingly, there is thus a desire to develop methods and apparatuses that are able to achieve the paper qualities comparable to those provided by fabric creping, but without the difficulties of the creping belt.

SUMMARY OF THE INVENTION

According to one aspect, our invention relates to a method of making a fibrous sheet. The method includes forming a nascent web from an aqueous solution of papermaking fibers and moving the nascent web on a transfer surface. The method also includes bringing a permeable patterned surface of a patterned cylinder into contact with the nascent web having a consistency from about twenty percent solids to about seventy percent solids. The patterned cylinder includes an interior and an exterior. The permeable patterned surface (i) is formed on the exterior of patterned cylinder, (ii) has at least one of a plurality of recesses and a plurality of protuberances, and (iii) is permeable to air. The method further includes conveying the nascent web between the transfer surface and the permeable patterned surface over an arc length of the permeable patterned surface. The arc length forms at least a portion of a molding zone. The method still further includes applying a vacuum over at least a portion of the arc length. The vacuum is applied in the interior of the patterned cylinder to cause air to flow through the permeable patterned surface into the interior of the patterned cylinder. The method also includes transferring the nascent web from the transfer surface to the permeable patterned surface of the patterned cylinder in the molding zone. The vacuum is applied during the transferring of the nascent web from the transfer surface to the permeable patterned surface of the patterned cylinder, such that papermaking fibers of the nascent web are (i) redistributed on the permeable patterned surface and (ii) drawn into the plurality of recesses of the permeable patterned surface in the molding zone to form a molded paper web. The method further includes transferring the molded paper web to a pick-up surface, and drying the molded paper web in a drying section to form a fibrous sheet.

According to another aspect, our invention relates to a method of making a fibrous sheet. The method includes forming a nascent web from an aqueous solution of papermaking fibers and moving the nascent web on a transfer surface. The method also includes bringing a patterned surface of a patterned cylinder into contact with the nascent web having a consistency from about twenty percent solids to about seventy percent solids. The patterned surface (i) is formed on the exterior of patterned cylinder and (ii) has at least one of a plurality of recesses and a plurality of protuberances. The method further includes conveying the nascent web between the transfer surface and the patterned surface over an arc length of the patterned surface, the arc length forming at least a portion of a molding zone. The method still further includes transferring the nascent web from the transfer surface to the patterned surface of the patterned cylinder in the molding zone, such that papermaking fibers of the nascent web are (i) redistributed on the patterned surface and (ii) shaped by at least one of the plurality of recesses and the plurality of protuberances of the patterned surface in the molding zone to form a molded paper web. The method further includes transferring the molded paper web to a pick-up surface, and drying the molded paper web in a drying section to form a fibrous sheet.

According to a further aspect, our invention relates to a method of making a fibrous sheet. The method includes forming a nascent web from an aqueous solution of papermaking fibers. The method also includes dewatering the nascent web by moving the nascent web on an outer surface of a steam filled drum to form a dewatered web having a consistency from about thirty percent solids to about sixty percent solids. The method further includes applying a vacuum at a molding zone. The molding zone is a nip defined between the outer surface of the steam filled drum and a permeable patterned surface of a patterned cylinder. The patterned cylinder includes an interior and an exterior. The permeable patterned surface (i) is formed on the exterior of patterned cylinder, (ii) has at least one of a plurality of recesses and a plurality of protuberances, and (iii) is permeable to air. The method still further includes transferring the dewatered web from the outer surface of the steam filled drum to the permeable patterned surface of the patterned cylinder in the molding zone. The vacuum is applied during the transferring of the nascent web from the transfer surface to the permeable patterned surface of the patterned cylinder, such that papermaking fibers of the nascent web are (i) redistributed on the permeable patterned surface and (ii) shaped by at least one of the plurality of recesses and the plurality of protuberances of the permeable patterned surface in the molding zone to form a molded paper web. In addition, the method includes transferring the molded paper web to a pick-up surface, and drying the molded paper web in a drying section to form a fibrous sheet.

According to yet another aspect, our invention relates to a method of making a fibrous sheet. The method includes forming a nascent web from an aqueous solution of papermaking fibers. The method also includes dewatering the nascent web by moving the nascent web on an outer surface of a steam filled drum to form a dewatered web having a consistency from about thirty percent solids to about sixty percent solids. The method further includes transferring the dewatered web from the outer surface of the steam filled drum to a patterned surface of a patterned cylinder in a molding zone. The molding zone is a nip defined between the outer surface of the steam filled drum and the patterned surface of the patterned cylinder. The patterned surface (i) is formed on the exterior of patterned cylinder and (ii) has at least one of a plurality of recesses and a plurality of protuberances. Whereby papermaking fibers of the nascent web are (i) redistributed on the patterned surface and (ii) shaped by at least one of the plurality of recesses and the plurality of protuberances of the patterned surface in the molding zone to form a molded paper web. In addition, the method includes transferring the molded paper web to a pick-up surface, and drying the molded paper web in a drying section to form a fibrous sheet.

These and other aspects of our invention will become apparent from the following disclosure.

DETAILED DESCRIPTION OF THE PREFERRED EMBODIMENTS

Figure 1:
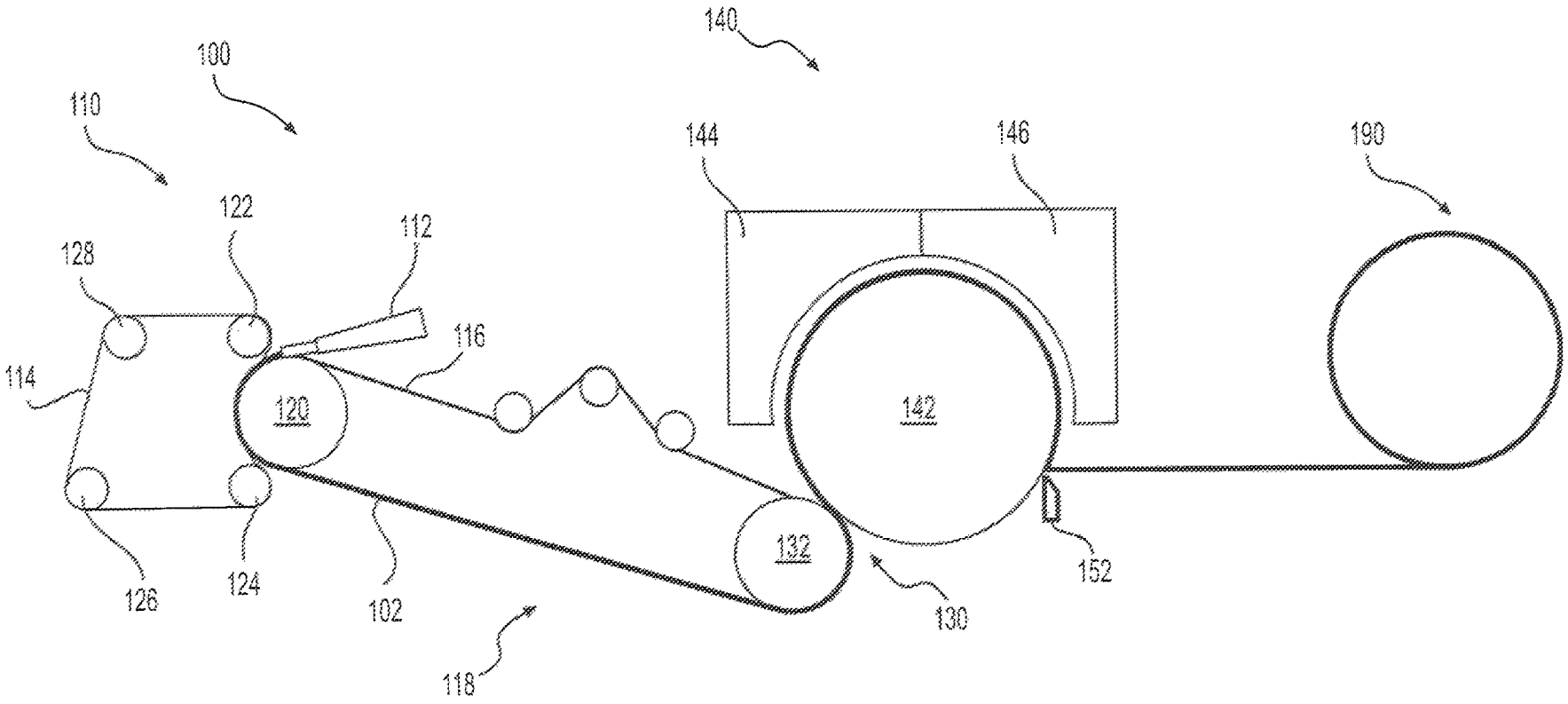
FIG. 1 is a schematic diagram of a conventional wet press papermaking machine.

Our invention relates to papermaking processes and apparatuses that use a patterned cylinder to produce a paper product. We will describe embodiments of our invention in detail below with reference to the accompanying figures. Throughout the specification and accompanying drawings, the same reference numerals will be used to refer to the same or similar components or features.

The term "paper product," as used herein, encompasses any product incorporating papermaking fibers. This would include, for example, products marketed as paper towels, toilet paper, facial tissues, etc. Papermaking fibers include virgin pulps or recycled (secondary) cellulosic fibers, or fiber mixes comprising at least fifty-one percent cellulosic fibers. Such cellulosic fibers may include both wood and non-wood fibers. Wood fibers include, for example, those obtained from deciduous and coniferous trees, including softwood fibers, such as northern and southern softwood kraft fibers, and hardwood fibers, such as *eucalyptus*, maple, birch, aspen, or the like. Examples of fibers suitable for making the products of our invention include nonwood fibers, such as cotton fibers or cotton derivatives, abaca, kenaf, sabai grass, flax, esparto grass, straw, jute hemp, bagasse, milkweed floss fibers, and pineapple leaf fibers. Additional papermaking fibers could include non-cellulosic substances such as calcium carbonite, titanium dioxide inorganic fillers, and the like, as well as typical manmade fibers like polyester, polypropylene, and the like, which may be added intentionally to the furnish or may be incorporated when using recycled paper in the furnish.

"Furnishes" and like terminology refers to aqueous compositions including papermaking fibers, and, optionally, wet strength resins, debonders, and the like, for making paper products. A variety of furnishes can be used in embodiments of our invention. In some embodiments, furnishes are used according to the specifications described in U.S. Pat. No. 8,080,130, the disclosure of which is incorporated by reference herein in its entirety. As used herein, the initial fiber and liquid mixture (or furnish) that is dried to a finished product in a papermaking process will be referred to as a "web," "paper web," a "cellulosic sheet," and/or a "fibrous sheet." The finished product may also be referred to as a cellulosic sheet and/or a fibrous sheet. In addition, other modifiers may variously be used to describe the web at a particular point in the papermaking machine or process. For example, the web may also be referred to as a "nascent web," a "moist nascent web," a "molded web," a "dewatered web," and a "dried web."

When describing our invention herein, the terms "machine direction" (MD) and "cross machine direction" (CD) will be used in accordance with their well understood meaning in the art. That is, the MD of a fabric or other structure refers to the direction that the structure moves on a papermaking machine in a papermaking process, while CD refers to a direction crossing the MD of the structure.

Similarly, when referencing paper products, the MD of the paper product refers to the direction on the product that the product moved on the papermaking machine in the papermaking process, and the CD of the product refers to the direction crossing the MD of the product.

When describing our invention herein, specific examples of operating conditions for the paper machine and converting line will be used. For example, various speeds and pressures will be used when describing paper production on the paper machine. Those skilled in the art will recognize that our invention is not limited to the specific examples of operating conditions including speeds and pressures that are disclosed herein.

I. First Embodiment of a Papermaking Machine

Figure 2:
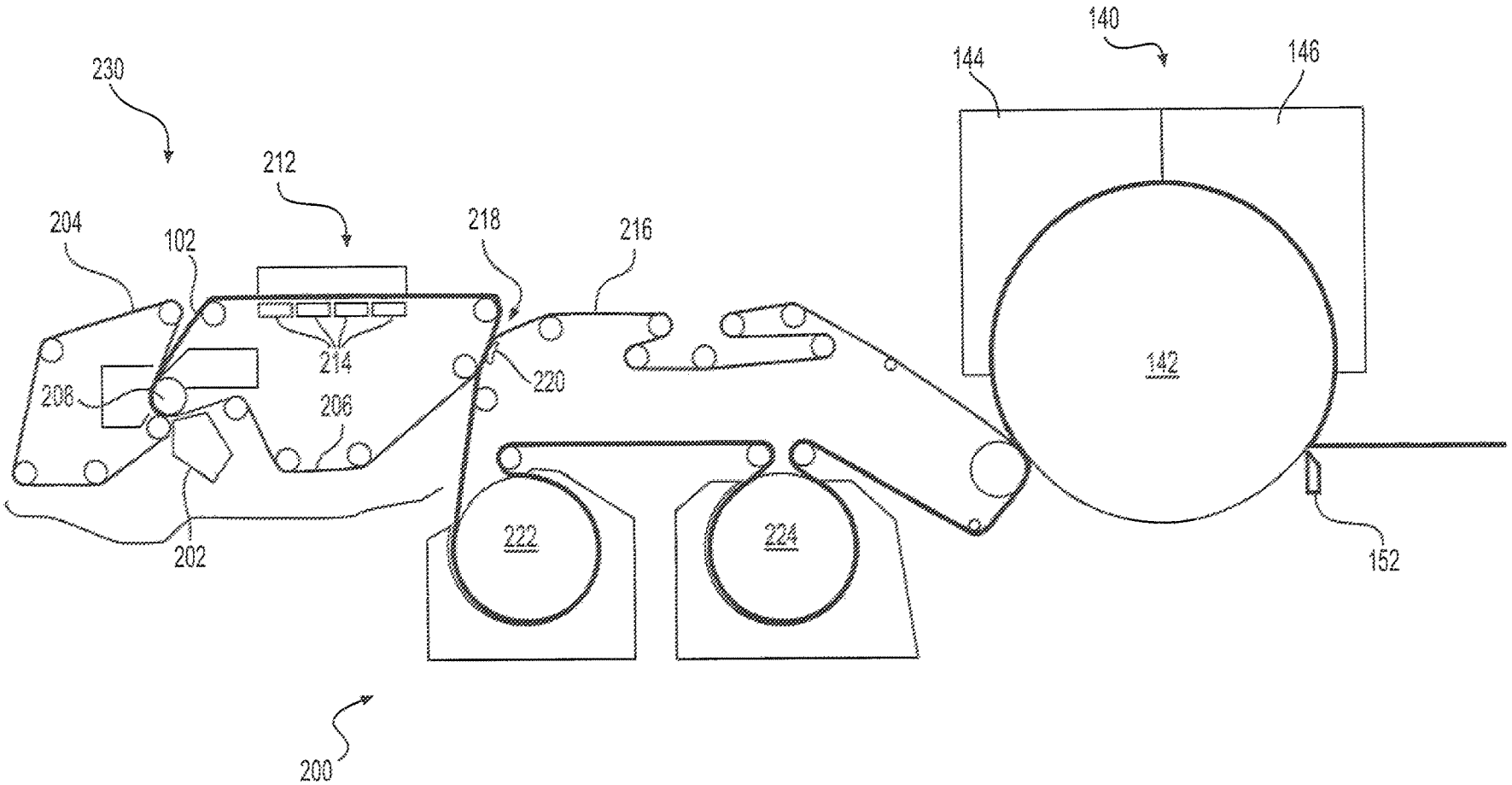
FIG. 2 is a schematic diagram of a through-air-drying papermaking machine.
Figure 3:
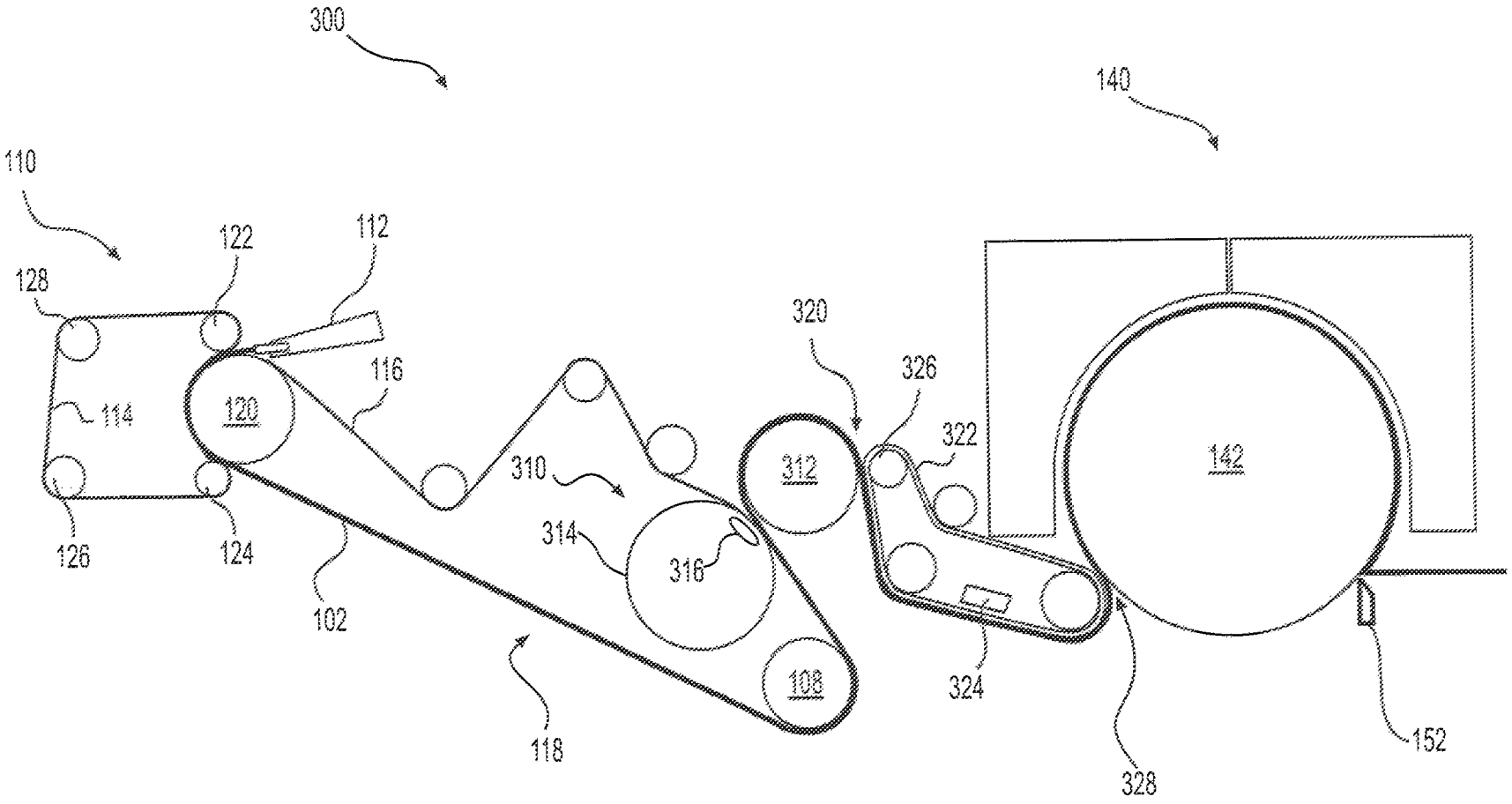
FIG. 3 is a schematic diagram of a papermaking machine used with belt creping.
Figure 4A:
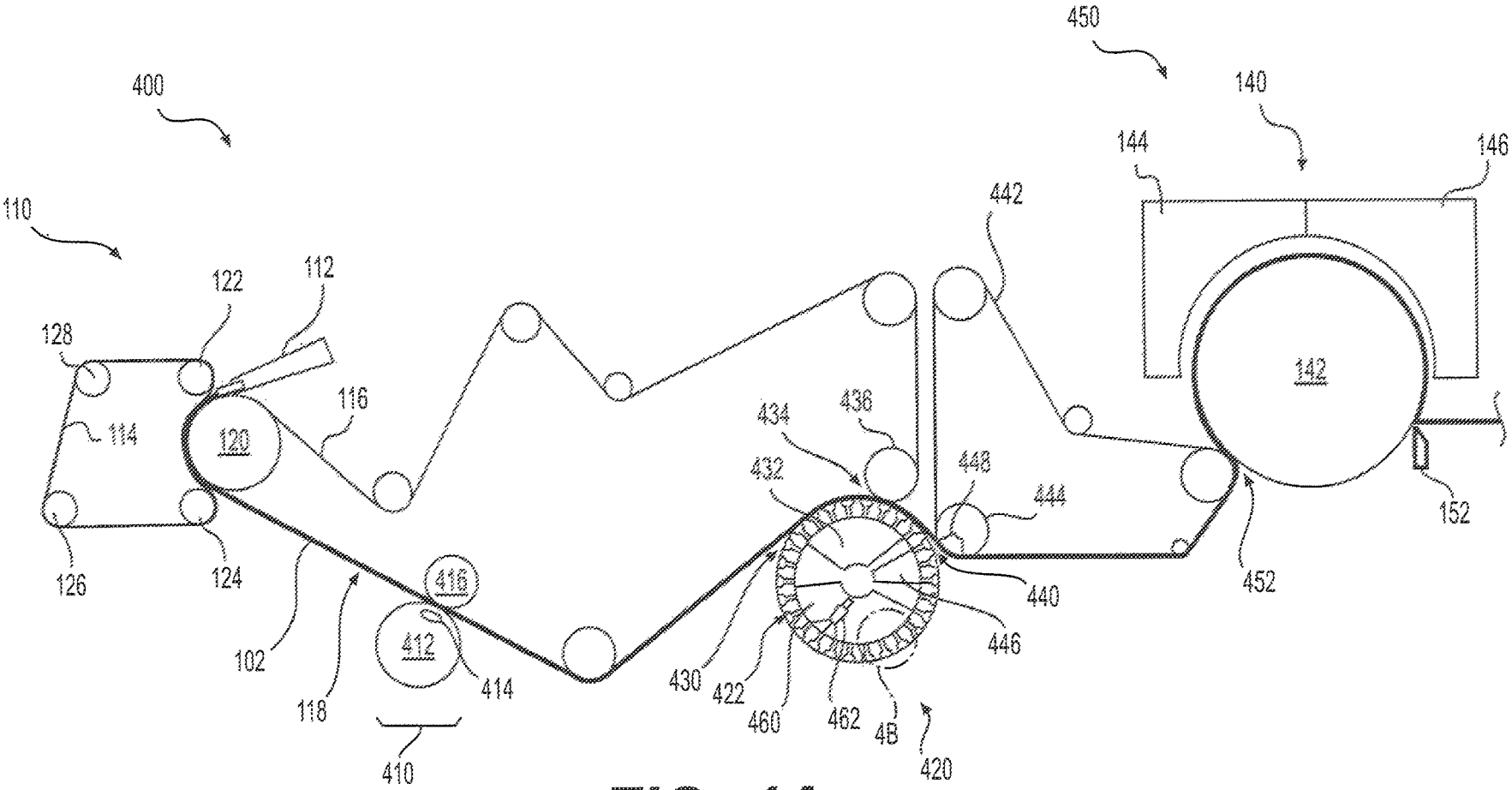
FIG. 4A is a schematic diagram of a papermaking machine configuration of a first preferred embodiment of our invention.

FIG. 4A shows a papermaking machine 400 used to create a paper web according to a first preferred embodiment of our invention. The forming section 110 of the papermaking machine 400 shown in FIG. 4A is a crescent former similar to the forming section 110 discussed above and shown in FIGS. 1 and 3. Other suitable forming sections may, however, be used. An example of such an alternative forming section is a twin-wire forming section 230, shown in FIG. 2. In such a configuration, downstream of the twin-wire forming section, the rest of the components of such a papermaking machine may be configured and arranged in a similar manner to that of papermaking machine 400. Another example of a papermaking machine with a twin-wire forming section can be seen in, U.S. Patent Application Pub. No. 2010/0186913 (the disclosure of which is incorporated by reference herein in its entirety). Still further examples of alternative forming sections that can be used in a papermaking machine include a C-wrap twin wire former, an S-wrap twin wire former, or a suction breast roll former. Those skilled in the art will recognize how these, or even still further alternative forming sections, can be integrated into a papermaking machine and used with the features of our invention discussed below.

As the nascent web 102 leaves the forming section 110, it is transferred along a felt run 118 and subsequently transferred to a patterned surface 422 of a patterned cylinder 420. The nascent web 102 is cylinder creped and molded on the patterned cylinder 420 to form a molded web 102, as will be discussed further below. The nascent web 102 may be cylinder creped and molded when it is wet and the fibers are mobile, such as at consistencies from about twenty percent solids to about seventy percent solids. In some embodiments, the nascent web 102 may be cylinder creped and molded without significant dewatering occurring after the forming section 110 and before the patterned cylinder 420, in which case, the nascent web 102 is preferably cylinder creped and molded at a consistency from about twenty percent solids to about thirty-five percent solids. The preferable consistency of the nascent web 102 may, however, vary depending upon the desired application.

In some embodiments, however, a dewatering section 410, separate from the forming section 110, may be used to dewater the nascent web 102 upstream of the patterned cylinder 420. The dewatering section 410 increases the solids content of the nascent web 102 to form a moist nascent web 102. The preferable consistency of the moist nascent web 102 may vary depending upon the desired application. In this embodiment, the nascent web 102 is dewatered to form a moist nascent web 102 having a consistency preferably between about thirty percent solids to about sixty percent solids, and more preferably between about forty percent solids to about fifty-five percent solids.

In this embodiment, the nascent web 102 is dewatered as it is moved on the papermaking felt 116. The dewatering section 410 shown in FIG. 4A uses a shoe press roll 412 to dewater the nascent web 102. The shoe 414 of the shoe press roll 412 presses the nascent web 102 and papermaking felt 116 against a backing roll 416 to remove water from the nascent web 102. Suitable press rolls 412 include, for example, a ViscoNip® press made by Valmet of Espoo, Finland, or the press described in U.S. Pat. No. 6,248,210 (the disclosure of which is incorporated by reference herein in its entirety). Those skilled in the art will recognize that the nascent web 102 may be dewatered using any suitable method known in the art including, for example, a roll press or a displacement press as described in U.S. Pat. Nos. 6,161,303 and 6,416,631, for example.

Figure 4C:
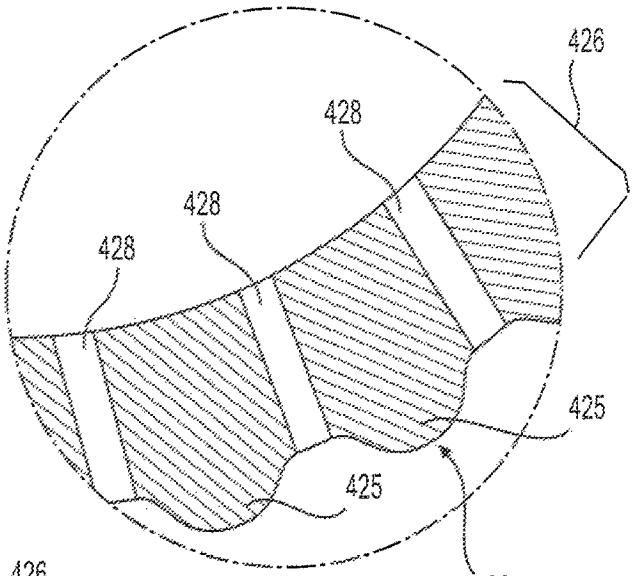
FIG. 4C is a detail view showing detail 4B of an alternate configuration of the shell of the patterned cylinder shown in FIG. 4A.
Figure 4D:
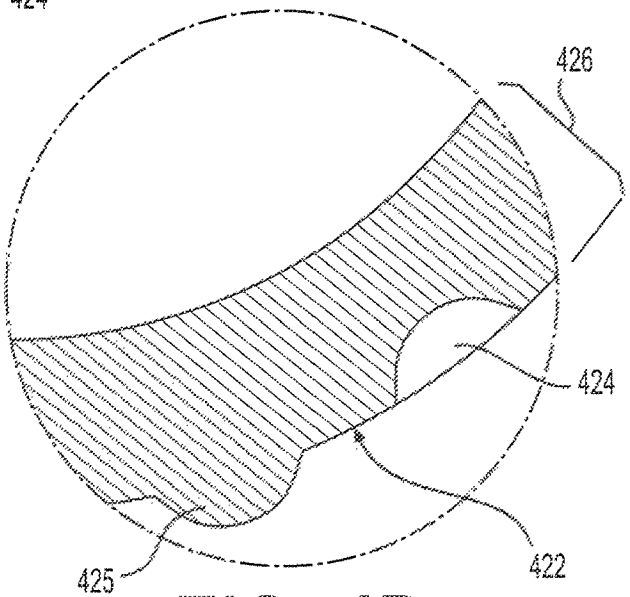
FIG. 4D is a detail view showing detail 4B of another alternate configuration of the shell of the patterned cylinder shown in FIG. 4A.
Figure 4B:
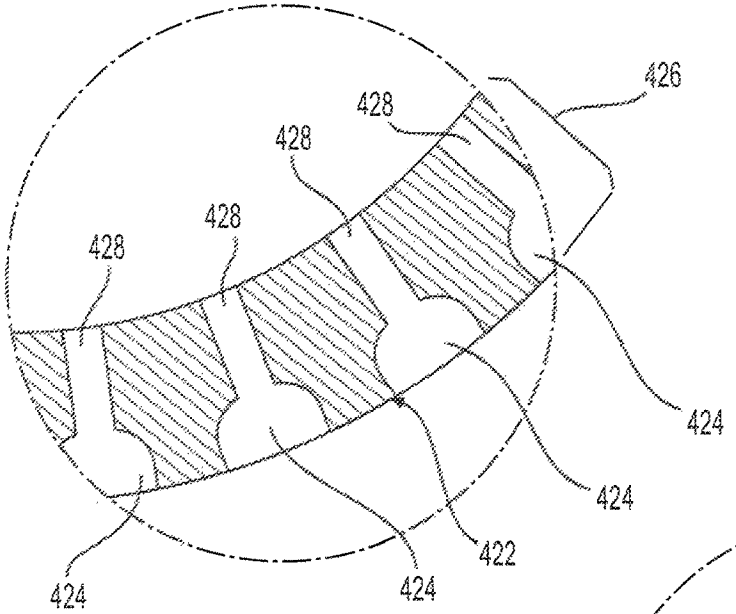
FIG. 4B is a detail view showing detail 4B of the shell of the patterned cylinder shown in FIG. 4A.

Regardless of whether or not the nascent web 102 is dewatered in the dewatering section 410, the nascent web 102 is moved by a transfer surface to a molding zone 430. In this embodiment, the transfer surface is the papermaking felt 116. The patterned surface 422 of the patterned cylinder 420 is brought into contact with the nascent web 102 in the molding zone 430, as the nascent web 102 is moved on the papermaking felt 116. The patterned surface 422 may include a plurality of recesses (or cells) 424 that are formed on a shell 426 of the patterned cylinder 420. FIG. 4B is a detail view showing detail 4B of the shell 426 of the patterned cylinder 420 with a plurality of recesses 424. The patterned surface 422 may also include a plurality of protuberances 425, as shown in FIG. 4C. The patterned surface 422 may also include both cells 424 and protuberances 425, as shown in FIG. 4D. The cells 424 may be formed using any suitable method including, for example, laser engraving, and may have any suitable pattern. Similarly the protuberances 425 may result from the laser engraving or be formed similarly to the way male embossing elements are formed on an embossing roller. With the patterned surface 422 being formed using these methods, there are few limits on the types of patterns that may be used or imparted to the web 102. Moreover, the shell 426 may be designed as a sleeve allowing for different shells 426, having, for example, different patterns to be used on the patterned cylinder 420.

Although the cells 424 and protuberances 425 may have any suitable depth or height, respectively, they are preferably from about ten-thousandths of an inch (mils) to about fifty mils. The cells 424 and protuberances 425 need not be uniform in either pattern or depth and height. For example, the patterned surface 422 may impart both a background pattern and a signature pattern to the web 102.

As shown in FIG. 4A, the patterned cylinder 420 is positioned with respect to the papermaking felt 116 such that the papermaking felt 116 presses the nascent web 102 into the patterned surface 422 of the patterned cylinder 420, and in particular the cells 424. In this embodiment, the nascent web 102 is pressed and conveyed between the papermaking felt 116 and the permeable patterned surface 422 over an arc length of the permeable patterned surface 422, as opposed to being pressed and molded in a nip, for example. Pressing the nascent web 102 into the permeable patterned surface 422 redistributes and reorients the papermaking fibers in the paper web 102 to have variable and patterned fiber orientations, forming a molded web 102. The arc length over which the nascent web 102 is conveyed between the papermaking felt 116 and the patterned surface 422 thus forms at least a portion of the molding zone 430. Suitable press loads may be from about eight pounds per square inch gauge (psig) to about thirty-two psig.

To further assist in molding the nascent web 102, a vacuum may also be applied in the molding zone 430. As can be seen in FIGS. 4B and 4C, the shell 426 of the patterned cylinder 420 includes a plurality of channels 428 that allows the patterned surface 422, and in particular the cells 424, to communicate with the interior of the patterned cylinder 420. (Although FIG. 4D shows an example of a non-permeable shell 426 which may be used without the vacuum or other features discussed below, the permeable shell 426 may also be used with the combination of cells 424 and protuberances 425.) As a result, in some embodiments, the patterned surface 422 is permeable and is also referred to herein as a permeable patterned surface 422. The density and geometry of the channels 428 in the shell 426 of the patterned cylinder 420 are preferably designed so that the shell 426 maintains suitable structural rigidity to withstand the operational conditions of the patterned cylinder 420, such as loads applied to the shell 426, and still provide relatively uniform vacuum or air pressure at the patterned surface 422, as will be discussed further below.

As shown in FIG. 4A, the shell 426 is rotatable about a stationary vacuum box 432 that is positioned on the interior of the patterned cylinder 420. Any suitable construction for the vacuum box 432 may be used, including the vacuum box shown and described for use in the molding roll of commonly assigned published International Application No. WO 2017/139123, No. WO 2017/139124, and No. WO 2017/139125 (the disclosures of which are incorporated by reference in their entirety). The vacuum box 432 extends under at least a portion of the arc length over which the nascent web 102 is conveyed between the papermaking felt 116 and the permeable patterned surface 422. In this embodiment, the vacuum box 432 begins at or just before the location where the permeable patterned surface 422 initially comes into contact with the nascent web 102 and extends beyond the point where the papermaking felt 116 separates from the paper web 102.

A vacuum is established in the vacuum box 432 and is used to draw a fluid, such as air, through the channels 428 of the shell 426, creating a vacuum in the molding zone 430. The vacuum in the molding zone 430, in turn, draws the paper web 102 onto the permeable patterned surface 422 of the patterned cylinder 420 and, in particular, into the plurality of cells 424. The vacuum thus molds the paper web 102 and reorients the papermaking fibers in the paper web 102 to have variable and patterned fiber orientations.

The paper web 102 is also transferred from the papermaking fabric 116 to the permeable patterned surface 422 of the patterned cylinder 420 in the molding zone 430. A first transfer nip 434 is formed between a support roll 436, supporting the papermaking fabric 116, and the patterned cylinder 420. As the papermaking fabric 116 and the permeable patterned surface 422 exit the first transfer nip 434, they diverge, and the paper web 102 remains on the permeable patterned surface 422 of the patterned cylinder 420. As discussed above when a vacuum is applied, the vacuum box 432 preferably extends and draws a vacuum beyond the first transfer nip 434 to assist in holding the paper web 102 on the permeable patterned surface 422, instead of following the papermaking felt 116. The first transfer nip 434 may also be loaded at a higher pressure than the loads imparted by the papermaking fabric 116 upstream of the first transfer nip 434 to assist in transferring the web 102.

The vacuum drawn by the vacuum box 432 is preferably set to achieve a desired depth of fiber penetration into the cells 424 of the permeable patterned surface 422 and to achieve consistent transfer of the paper web 102 from the papermaking felt 116 to the permeable patterned surface 422. Preferably, the vacuum is from about five inches of mercury to about twenty-five inches of mercury.

To further assist molding and transfer, the nascent web 102 may be transferred from the papermaking fabric 116 to the patterned cylinder 420 by a rush transfer. During a rush transfer, the patterned cylinder 420 is traveling at a slower speed than the papermaking fabric 116 and thus the paper web 102. In this regard, the web 102 is creped by the speed differential and the degree of creping is often referred to as the creping ratio. The creping ratio (expressed in terms of percent) in this embodiment may be calculated according to Equation (1) as:

$$\text{Creping Ratio } (\%) = (S_1/S_2 - 1) \times 100\% \qquad \text{Equation (1)}$$

where $S_1$ is the speed of the papermaking fabric 116 and $S_2$ is the speed of the patterned cylinder 420. The creping ratio is often proportional to the degree of bulk in the sheet, but inversely proportional to the throughput of the papermaking machine 400 and thus yield of the papermaking machine 400. In this embodiment, the velocity of the paper web 102 on the papermaking felt 116 may preferably be from about one thousand feet per minute to about six thousand five hundred feet per minute. More preferably velocity of the paper web 102 on the papermaking felt 116 is as fast as the process allows, which is typically limited by the drying section 450. For higher bulk product where a slower papermaking machine speeds can be accommodated, a higher creping ratio is used.

After being molded in the molding zone 430, the molded paper web 102 is conveyed to a second transfer nip 440, where the molded paper web 102 is transferred from the permeable patterned surface 422 of the patterned cylinder 420 to a pick-up surface. In this embodiment the pick-up surface is a pick-up fabric 442, although other suitable pick-up surfaces may be used including a belt or a roll for example. The second transfer nip 440 may be formed between the patterned cylinder 420 and a support roll 444, supporting the pick-up fabric 442.

The patterned cylinder 420 may also have a blow box 446 at the second transfer nip 440 where the web 102 is transferred from the permeable patterned surface 422 to the pick-up fabric 442. Any suitable construction for the blow box 446 may be used, including the blow box shown and described for use in the molding roll of commonly assigned published International Application No. WO 2017/139123, No. WO 2017/139124, and No. WO 2017/139125 (the disclosures of which are incorporated by reference in their entirety). Positive air pressure may be exerted from the blow box 446 through the channels 428 and permeable patterned surface 422 of patterned cylinder 420. The positive air pressure facilitates the transfer of the molded web 102 at second transfer nip 440 by pushing the web 102 away from the permeable patterned surface 422 and towards the pick-up fabric 442. The pressure in the blow box 446 is set at a level sufficient to achieve consistent transfer of the molded web 102 to the pick-up fabric 442 and low enough to avoid inducing defects into the web 102 because the of air from the blow box 446. There should be enough pressure drop across the web 102 to cause it to release from the permeable patterned surface 422. The blow box 446 may preferably extend and blow air beyond the second transfer nip 440 to assist in retaining the molded web 102 on the pick-up fabric 442, instead of following the permeable patterned surface 422 of the patterned cylinder 420.

In the embodiment shown in FIG. 4A, the pick-up fabric support roll 444 is a vacuum pick-up roll. The vacuum pick-up roll 444 includes a vacuum box 448 to apply a vacuum at the second transfer nip 440. The vacuum applied by the vacuum pick-up roll 444 further assists in transferring the molded web 102 from the permeable patterned surface 422 to the pick-up fabric 442. As with the blow box 446, the vacuum box 448 of the vacuum pick-up roll 444 may preferably extend and draw a vacuum beyond the second transfer nip 440 to assist in holding the molded web 102 on the pick-up fabric 442, instead of following the permeable patterned surface 422 of the patterned cylinder 420.

A speed differential between the patterned cylinder 420 and the pick-up fabric 442 may also be used to assist in transferring the molded web 102 from the patterned cylinder 420 to the pick-up fabric 442. When a speed differential is used, the creping ratio (expressed in terms of percent) is calculated using Equation (2), which is similar to Equation (1), as follows:

$$\text{Creping Ratio } (\%)=(S_2/S_3-1)\times 100\% \qquad \text{Equation (2)}$$

where $S_2$ is the speed of the patterned cylinder 420 and $S_3$ is the speed of the pick-up fabric 422. Preferably, the web 102 is creped at a ratio of about twenty percent to about two hundred percent, and more preferably from about sixty percent to about one hundred fifteen percent. When rush transfer is used in both the molding zone 430 and the second transfer nip 440, the total creping ratio can be calculated by adding the creping ratios in each nip and controlled to achieve the preferred creping ratios discussed above.

After being molded, the molded web 102 is transferred by the pick-up fabric 442 to a drying section 450 where the web 102 is further dried to a consistency of about ninety-five percent solids. The drying section 450 may principally comprise a Yankee dryer section 140. As discussed above, the Yankee dryer section 140 includes, for example, a steam filled drum 142 ("Yankee drum") that is used to dry the web 102. In addition, hot air from wet end hood 144 and dry end hood 146 is directed against the web 102 to further dry the web 102 as the web 102 is conveyed on the Yankee drum 142.

The web 102 is deposited on the surface of the Yankee drum 142 at a nip 452. A creping adhesive may be applied to the surface of the Yankee drum 142 to help the web 102 adhere to the Yankee drum 142. As the Yankee drum 142 rotates, the web 102 may be removed from the Yankee drum 142 by a doctor blade 152 where it is then wound on a reel (not shown) to form a parent roll. The reel may be operated slower than the Yankee drum 142 at steady-state in order to impart a further crepe to the web 102.

With use, the permeable patterned surface 422 of the patterned cylinder 420 may require cleaning. Papermaking fibers and other substances may be retained on the patterned surface 422 and, in particular, the cells 424 and channels 428. At any one time during operation, only a portion of the patterned surface 422 is contacting and molding the paper web 102. In the arrangement of rolls shown in FIG. 4A, about half of the circumference of the patterned cylinder 420 is contacting the paper web 102 and the other half is not. The portion of the patterned surface 422 not contacting the paper web 102 is referred to herein as a "free surface" of the patterned surface 422. A cleaning section 460 may be constructed inside the patterned cylinder 420 in the section of the patterned cylinder 420 having the free surface. An advantage of the permeable patterned surface 422 is that cleaning devices may be placed on the interior of the molding roll to clean the patterned surface 422 and, in particular, the cells 424 and channels 428 by directing a cleaning solution or cleaning medium outward. One suitable cleaning device may be a shower 462 located in the patterned cylinder 420. The shower 462 may spray water and/or a cleaning solution (as the cleaning medium) outward through the channels 428 and permeable patterned surface 422 to clean them. Other suitable a cleaning devices may include, for example, a blow box (not shown) or an air knife (not shown) that forces pressurized air (as the cleaning medium) though the channels 428 and permeable patterned surface 422.

II. Second Embodiment of a Papermaking Machine

Figure 5:
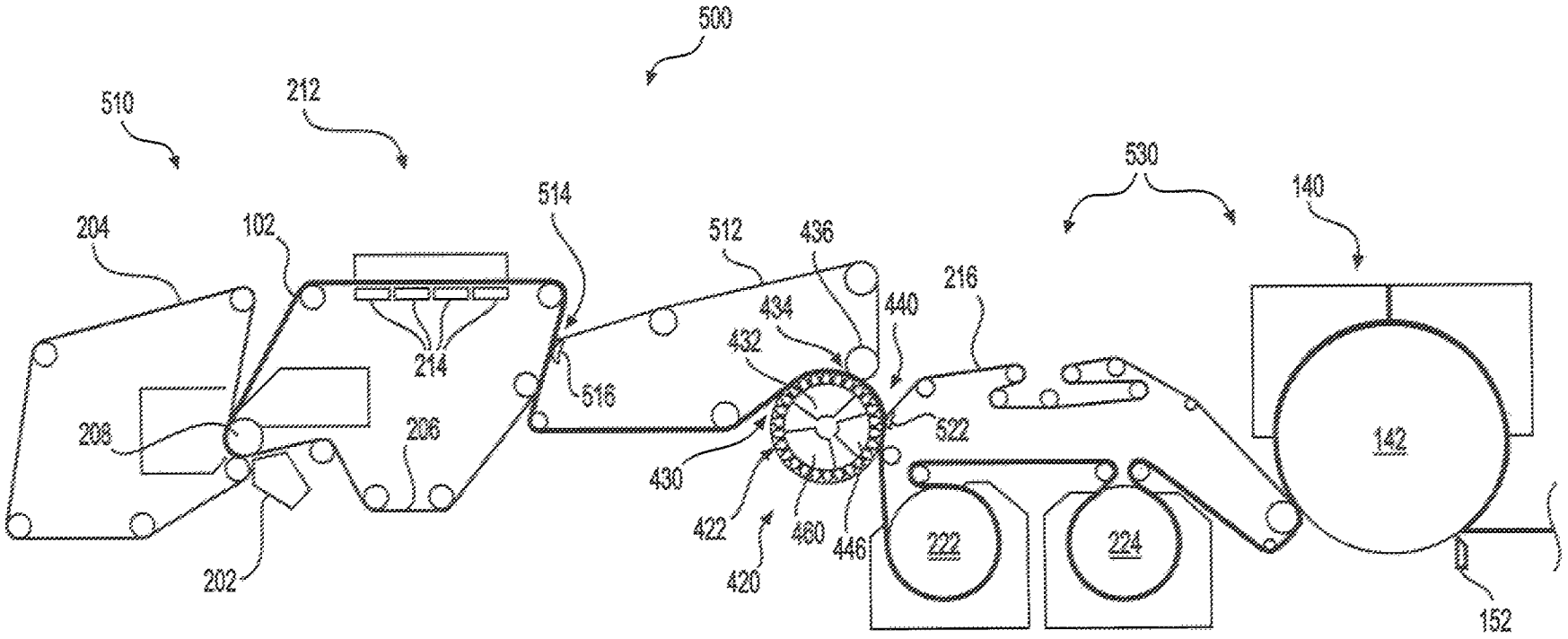
FIG. 5 is a schematic diagram of a papermaking machine configuration of a second preferred embodiment of our invention.

FIG. 5 shows a second preferred embodiment of our invention. We have found that the lower the consistency of the moist nascent web 102 is when it is molded on the molding roll, the greater effect molding has on desirable sheet properties such as bulk and absorbency. Thus, in general, it is advantageous to minimally dewater the nascent web 102 to increase sheet bulk and absorbency, and in some cases, the dewatering that occurs during forming may be sufficient for molding. When the web 102 is minimally dewatered, the moist nascent web 102 preferably has a consistency between about twenty percent solids to about thirty-five percent solids, more preferably, between about twenty percent solids to about thirty percent solids. With such a low consistency, more of the dewatering/drying will occur subsequent to molding. A non-compactive drying process may be used in order to preserve as much of the structure imparted to the web 102 during molding as possible. One suitable non-compactive drying process is the use of TAD. Among the various embodiments, the moist nascent web 102 may thus be molded over a range of consistencies extending from about twenty percent solids to about seventy percent solids.

FIG. 5 shows an example papermaking machine 500 of the second embodiment using a TAD drying section 530, along with the patterned cylinder 420 discussed above with reference to FIG. 4A. Although any suitable forming section 510 may be used to form and to dewater the web 102, in this embodiment, the forming section 510 is a twin wire forming section, similar to that discussed above with respect to FIG. 2. The web 102 is then transferred from the second forming fabric 206 to a transfer fabric 512 at transfer nip 514, where a shoe 516 presses the transfer fabric 512 against the second forming fabric 206. The shoe 516 may be a vacuum shoe that applies a vacuum to assist in the transfer of the web 102 to the transfer fabric 512.

The web 102 is then transferred by the transfer fabric 512 to the molding zone 430, where web 102 is molded and transferred from the transfer fabric to the permeable patterned surface 422 of the patterned cylinder 420, as discussed above with reference to FIG. 4A. After molding, the molded web 102 is then transferred from the patterned cylinder 420 to a drying section 530 at the second transfer nip 440. In this embodiment, the pick-up surface is a through-air drying fabric 216. As in the papermaking machine 200 discussed above with reference to FIG. 2, a vacuum may be applied to assist in the transfer of the web 102 from the patterned cylinder 420 to the through-air drying fabric 216 using a vacuum shoe 522 in the second transfer nip 440.

The fabric 216 carrying the paper web 102 next passes around through-air dryers 222, 224 where hot air is forced through the web 102 to increase the consistency of the paper web 102, to about eighty percent solids. The web 102 is then transferred to the Yankee dryer section 140, where the web 102 is further dried and, after being removed from the Yankee dryer section 140 by doctor blade 152, is taken up by a reel (not shown) to form a parent roll (not shown).

Alternatively, the nascent web 102 may be minimally dewatered with a separate dewatering zone 212. In this embodiment, the dewatering zone 212 is a vacuum dewatering zone in which suction boxes 214 remove moisture from the web 102 to achieve desirable consistencies of about twenty percent solids and about thirty-five percent solids before the sheet reaches molding zone 430. Hot air may also be used in dewatering zone 212 to improve dewatering.

III. Third Embodiment of a Papermaking Machine

Figure 6:
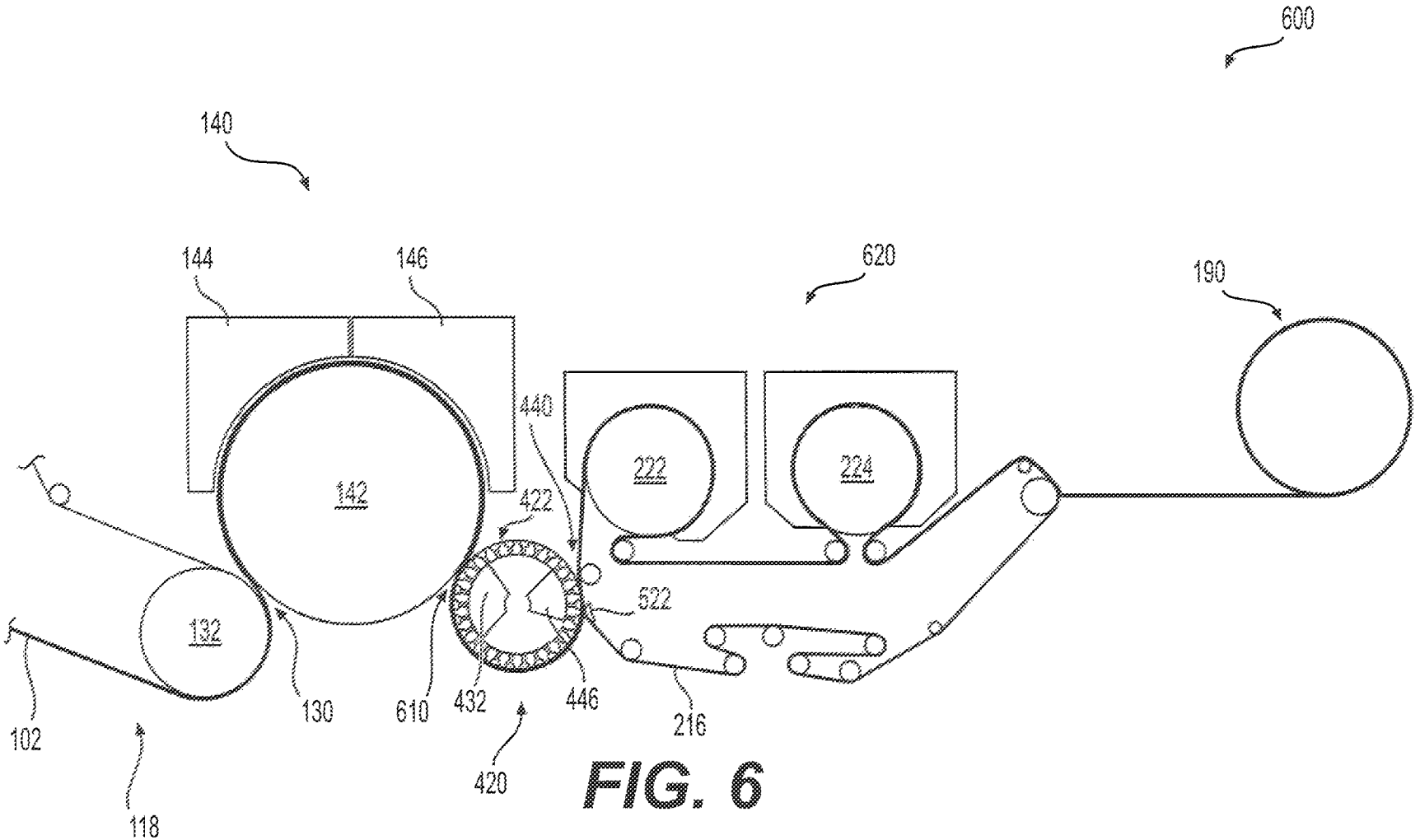
FIG. 6 is a schematic diagram of a papermaking machine configuration of a third preferred embodiment of our invention.

FIG. 6 shows an example papermaking machine 600 of a third embodiment of our invention. Here a molding nip 610 formed between the patterned cylinder 420 and a Yankee drum 142, and a moist nascent web 102 is molded by the patterned cylinder 420 to form a molded web 102 in the molding nip 610. In this embodiment, the nascent web 102 is formed similarly to the CWP papermaking machine 100 described above with reference to FIG. 1 (additional features of the Yankee drying section 140 are also discussed in the first embodiment with reference to FIG. 4 and drying section 450). In this embodiment, however, the press nip 130 and Yankee dryer section 140 are used to dewater the web 102 to form a moist nascent web 102. Preferably the moist nascent web 102 will have a consistency from about thirty percent solids to about sixty percent solids, and more preferably from about forty percent solids to about fifty-five percent solids, as it enters the molding nip 610.

The moist nascent web 102 is transferred from the Yankee drum 142 to the patterned cylinder 420 in the molding nip 610. To further assist molding and transfer, the moist nascent web 102 may be transferred from the Yankee drum 142 to the patterned cylinder 420 by a rush transfer. When a speed differential is used, the creping ratio (expressed in terms of percent) is calculated using Equation (3), which is similar to Equations (1) and (2), as follows:

$$\text{Creping Ratio } (\%) = (S_4/S_5 - 1) \times 100\% \qquad \text{Equation (3)}$$

where $S_4$ is the speed of the Yankee drum 142 and $S_5$ is the speed of the patterned cylinder 420. Preferably, the moist nascent web 102 is creped at a ratio of about twenty percent to about two hundred percent, and more preferably from about sixty percent to about one hundred fifteen percent.

As with the previous embodiments, the patterned surface 422 of the patterned cylinder 420 may be permeable to allow a vacuum to be drawn by a vacuum box 432 in the molding nip 610 to assist both in transfer and molding of the web 102. When the a permeable patterned surface 422 is used, other features such as the blow box 446 and cleaning section 460 may also be used.

After being molded, the molded web 102 is transferred from the patterned cylinder 420 to a drying section 620 to form a dried web 102. In this embodiment, a non-compactive drying process, such as a the TAD drying section 530 shown and described above in the second embodiment with reference to FIG. 5, is used to avoid altering the imparted pattern to the molded web 102. The molded web 102 may be transferred to the TAD fabric 216 in the second transfer nip 440 described above in the second embodiment with reference to FIG. 5. After being dried by the through-air dryers 222, 224, the dried web 102 is removed from the TAD fabric 216 where it is then wound on a reel (not shown) to form a parent roll 190.

IV. Other Embodiments

Multiple patterned cylinders 420 may be used in the embodiments discussed above to mold and impart a pattern to the nascent (moist nascent) web 102. For example, a first, background pattern may be imparted by a first patterned cylinder 420 and then a second, signature pattern may be superimposed over the background pattern by a second patterned cylinder 420. When two patterned cylinders 420 are used with the embodiments described above, both patterned cylinders 420 may be located upstream of the drying section (450, 530, 620, respectively) and process the web 102 without intermediate drying between the two patterned cylinders 420, resulting in both patterns being imparted to the web 102 at similar consistencies.

Another variation using two patterned cylinders 420 may be a combination of the first embodiment and the third embodiment. The first patterned cylinder 420 may be located and operated as described in the first embodiment with reference to FIG. 4. The Yankee drum 142 and the second patterned cylinder 420 may be operated as described in the third embodiment with reference to FIG. 6. The molded web 102 may then be dried to form a dried web 102 as described in the third embodiment with reference to FIG. 6. Preferably, the papermaking machine employing this variation will be configured such that both the first and second patterns are imparted to the same surface of the paper web 102.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

This invention can be used to produce desirable paper products, such as paper towels and bath tissue. Thus, this invention is applicable to the paper products industry.

We claim:

1. A method of making a fibrous sheet, the method comprising:

(a) forming a nascent web from an aqueous solution of papermaking fibers;

(b) applying the nascent web to a transfer surface and moving the nascent web on the transfer surface;

(c) bringing a permeable patterned surface of a patterned cylinder into contact with the nascent web after the nascent web has been applied to the transfer surface, the nascent web having a consistency from about twenty percent solids to about seventy percent solids when the permeable patterned surface is brought into contact with the nascent web, the patterned cylinder including an interior and an exterior, the permeable patterned surface (i) being formed on the exterior of the patterned cylinder, (ii) having at least one of a plurality of recesses and a plurality of protuberances, and (iii) being permeable to air;

(d) conveying the nascent web between the transfer surface and the permeable patterned surface over an arc length of the permeable patterned surface, the arc length forming at least a portion of a molding zone;

(e) applying a vacuum over at least a portion of the arc length, the vacuum being applied in the interior of the patterned cylinder to cause air to flow through the permeable patterned surface into the interior of the patterned cylinder;

(f) transferring the nascent web from the transfer surface to the permeable patterned surface of the patterned cylinder in the molding zone, the vacuum being applied during the transferring of the nascent web from the transfer surface to the permeable patterned surface of the patterned cylinder, such that papermaking fibers of the nascent web are (i) redistributed on the permeable patterned surface and (ii) shaped by at least one of the plurality of recesses and the plurality of protuberances of the permeable patterned surface in the molding zone to form a molded paper web;

(g) transferring the molded paper web from the permeable patterned surface of the patterned cylinder to a pick-up surface; and (h) drying the molded paper web in a drying section to form a fibrous sheet.

2. The method of claim 1, wherein, in the step of bringing a permeable patterned surface of a patterned cylinder into contact with the nascent web, the nascent web has a consistency from about twenty percent solids to about thirty-five percent solids.

3. The method of claim 1, further comprising dewatering the nascent web to form a dewatered web.

4. The method of claim 3, wherein the dewatering comprises dewatering the nascent web using at least one of a shoe press, a roll press, vacuum dewatering, a displacement press, and thermal drying.

5. The method of claim 3, wherein the dewatering occurs prior to the step of transferring the nascent web to the permeable patterned surface of the patterned cylinder.

6. The method of claim 3, wherein the dewatered web has a consistency from about thirty percent solids to about sixty percent solids.

7. The method of claim 3, wherein the dewatered web has a consistency from about forty percent solids to about fifty-five percent solids.

8. The method of claim 1, wherein the vacuum is from about five inches of mercury to about twenty-five inches of mercury.

9. The method of claim 1, wherein the conveying step includes pressing the nascent web into the patterned surface of the patterned cylinder.

10. The method of claim 9, wherein the nascent web is pressed with a force from about eight pounds per square inch gauge to about thirty-two pounds per square inch gauge.

11. The method of claim 1, further comprising:

(i) moving the transfer surface at a transfer surface speed; and (j) rotating the permeable patterned surface of the patterned cylinder at a cylinder speed, the transfer surface speed being faster than the cylinder speed.

12. The method of claim 1, further comprising applying positive air pressure in the interior of the patterned cylinder to cause air to flow through the permeable patterned surface of the patterned cylinder away from the interior of the patterned cylinder in a radial direction, the positive air pressure being applied to transfer the molded paper web away from the permeable patterned surface.

13. The method of claim 12, wherein the positive air pressure is applied during the transfer of the molded web to the pick-up surface.

14. The method of claim 1, further comprising applying a second vacuum at a vacuum zone, the second vacuum being applied to draw the molded web from the permeable patterned surface of the patterned cylinder to the pick-up surface, the molded web being transferred from the permeable patterned surface of the patterned cylinder to the pick-up surface in the vacuum zone.

15. The method of claim 14, wherein the pick-up surface comprises a fabric or a belt, and the vacuum is applied by a suction roll.

16. The method of claim 1, wherein the pick-up surface comprises a fabric or a belt.

17. The method of claim 1, wherein the molded web is transferred to the pick-up surface at a nip formed between the permeable patterned surface and the pick-up surface.

18. The method of claim 1, further comprising:

(i) rotating the permeable patterned surface of the patterned cylinder at a cylinder speed; and (j) moving the pick-up surface at a pick-up surface speed, the cylinder speed being faster than the pick-up surface speed.

19. The method of claim 18, wherein the creping ratio between the patterned cylinder and the pick-up surface is from about sixty percent to about one hundred fifteen percent.

20. The method of claim 1, wherein the drying section comprises a Yankee dryer and the drying step includes drying the molded paper web using the Yankee dryer.

21. The method of claim 1, wherein the drying section comprises a through-air dryer and the drying step includes drying the molded paper web using the through-air dryer.

22. The method of claim 21, wherein the drying section further comprises a through-air drying fabric, and the pick-up surface is the through-air drying fabric.

23. The method of claim 1, further comprising cleaning the permeable patterned surface of the patterned cylinder at a free surface of the patterned cylinder.

24. The method of claim 23, wherein the cleaning includes directing a cleaning medium through the permeable patterned surface away from the interior of the patterned cylinder in a radial direction of the patterned cylinder.

25. The method of claim 24, wherein the cleaning medium includes at least one of air, water, and a cleaning solution.

26. A method of making a fibrous sheet, the method comprising:

(a) forming a nascent web from an aqueous solution of papermaking fibers;

(b) applying the nascent web to a transfer surface and moving the nascent web on the transfer surface;

(c) bringing a patterned surface of a patterned cylinder into contact with the nascent web after the nascent web has been applied to the transfer surface, the nascent web having a consistency from about twenty percent solids to about seventy percent solids when the patterned surface is brought into contact with the nascent web, the patterned surface (i) being formed on the exterior of the patterned cylinder and (ii) having at least one of a plurality of recesses and a plurality of protuberances;

(d) conveying the nascent web between the transfer surface and the patterned surface over an arc length of the patterned surface, the arc length forming at least a portion of a molding zone;

(e) transferring the nascent web from the transfer surface to the patterned surface of the patterned cylinder in the molding zone, such that papermaking fibers of the nascent web are (i) redistributed on the patterned surface and (ii) shaped by at least one of the plurality of recesses and the plurality of protuberances of the patterned surface in the molding zone to form a molded paper web;

(f) transferring the molded paper web from the patterned surface of the patterned cylinder to a pick-up surface; and (g) drying the molded paper web in a drying section to form a fibrous sheet.

27. The method of claim 26, wherein, in the step of bringing a patterned surface of a patterned cylinder into contact with the nascent web, the nascent web has a consistency from about twenty percent solids to about thirty-five percent solids.

28. The method of claim 26, further comprising dewatering the nascent web to form a dewatered web.

29. The method of claim 28, wherein the dewatering comprises dewatering the nascent web using at least one of a shoe press, a roll press, vacuum dewatering, a displacement press, and thermal drying.

30. The method of claim 28, wherein the dewatering occurs prior to the step of transferring the nascent web to the patterned surface of the patterned cylinder.

31. The method of claim 28, wherein the dewatered web has a consistency from about thirty percent solids to about sixty percent solids.

32. The method of claim 28, wherein the dewatered web has a consistency from about forty percent solids to about fifty-five percent solids.

33. The method of claim 26, wherein the conveying includes pressing the nascent web into the patterned surface of the patterned cylinder.

34. The method of claim 33, wherein the nascent web is pressed with a force from about eight pounds per square inch gauge to about thirty-two pounds per square inch gauge.

35. The method of claim 26, further comprising:

(h) moving the transfer surface at a transfer surface speed; and (i) rotating the patterned surface of the patterned cylinder at a cylinder speed, the transfer surface speed being faster than the cylinder speed.

36. The method of claim 26, further comprising applying a vacuum at a vacuum zone, the vacuum being applied to draw the molded web from the patterned surface of the patterned cylinder to the pick-up surface, the molded web being transferred from the patterned surface of the patterned cylinder to the pick-up surface in the vacuum zone.

37. The method of claim 36, wherein the pick-up surface comprises a fabric or a belt, and the vacuum is applied by a suction roll.

38. The method of claim 26, wherein the pick-up surface comprises a fabric or a belt.

39. The method of claim 26, wherein the molded web is transferred to the pick-up surface at a nip formed between the patterned surface and the pick-up surface.

40. The method of claim 26, further comprising:

(h) rotating the patterned surface of the patterned cylinder at a cylinder speed; and (i) moving the pick-up surface at a pick-up surface speed, the cylinder speed being faster than the pick-up surface speed.

41. The method of claim 40, wherein the creping ratio between the patterned cylinder and the pick-up surface is from about sixty percent to about one hundred fifteen percent.

42. The method of claim 26, wherein the drying section comprises a Yankee dryer and the drying step includes drying the molded paper web using the Yankee dryer.

43. The method of claim 26, wherein the drying section comprises a through-air dryer and the drying step includes drying the molded paper web using the through-air dryer.

44. The method of claim 42, wherein the drying section further comprises a through-air drying fabric, and the pick-up surface is the through-air drying fabric.

45. A method of making a fibrous sheet, the method comprising:

(a) forming a nascent web from an aqueous solution of papermaking fibers;

(b) applying the nascent web to an outer surface of a steam filled drum and dewatering the nascent web by moving the nascent web on the outer surface of the steam filled drum to form a dewatered web having a consistency from about thirty percent solids to about sixty percent solids;

(c) applying a vacuum at a molding zone, the molding zone being a nip defined between the outer surface of the steam filled drum and a permeable patterned surface of a patterned cylinder, the patterned cylinder including an interior and an exterior, the permeable patterned surface (i) being formed on the exterior of the patterned cylinder, (ii) having at least one of a plurality of recesses and a plurality of protuberances, and (iii) being permeable to air;

(d) transferring the dewatered web from the outer surface of the steam filled drum to the permeable patterned surface of the patterned cylinder in the molding zone, the vacuum being applied during the transferring of the nascent web from the outer surface of the steam filled drum to the permeable patterned surface of the patterned cylinder, such that papermaking fibers of the dewatered web are (i) redistributed on the permeable patterned surface and (ii) shaped by at least one of the plurality of recesses and the plurality of protuberances of the permeable patterned surface in the molding zone to form a molded paper web;

(e) transferring the molded paper web from the permeable patterned surface of the patterned cylinder to a pick-up surface; and (f) drying the molded paper web in a drying section to form a fibrous sheet.

46. The method of claim 45, wherein the dewatered web has a consistency from about forty percent solids to about fifty-five percent solids.

47. The method of claim 45, wherein the dewatering further includes directing hot air from a hood against the nascent web.

48. The method of claim 45, wherein the vacuum is from about five inches of mercury to about twenty-five inches of mercury.

49. The method of claim 45, further comprising:

(g) moving the outer surface of the steam filled drum at a drum speed; and (h) rotating the permeable patterned surface of the patterned cylinder at a cylinder speed, the drum speed being faster than the cylinder speed.

50. The method of claim 49, wherein the creping ratio between the patterned cylinder and the pick-up surface is from about sixty percent to about one hundred fifteen percent.

51. The method of claim 45, further comprising applying positive air pressure in the interior of the patterned cylinder to cause air to flow through the permeable patterned surface of the patterned cylinder away from the interior of the patterned cylinder in a radial direction, the positive air pressure being applied to transfer the molded paper web away from the permeable patterned surface.

52. The method of claim 51, wherein the positive air pressure is applied during the transfer of the molded web to the pick-up surface.

53. The method of claim 45, further comprising applying a second vacuum at a vacuum zone, the second vacuum being applied to draw the molded web from the permeable patterned surface of the patterned cylinder to the pick-up surface, the molded web being transferred from the permeable patterned surface of the patterned cylinder to the pick-up surface in the vacuum zone.

54. The method of claim 53, wherein the pick-up surface comprises a fabric or a belt, and the vacuum is applied by a suction roll.

55. The method of claim 45, wherein the pick-up surface comprises a fabric or a belt.

56. The method of claim 45, wherein the molded web is transferred to the pick-up surface at a nip formed between the permeable patterned surface and the pick-up surface.

57. The method of claim 45, further comprising:

(g) rotating the permeable patterned surface of the patterned cylinder at a cylinder speed; and (h) moving the pick-up surface at a pick-up surface speed, the cylinder speed being faster than the pick-up surface speed.

58. The method of claim 45, wherein the drying section comprises a through-air dryer and the drying step includes drying the molded paper web using the through-air dryer.

59. The method of claim 58, wherein the drying section further comprises a through-air drying fabric, and the pick-up surface is the through-air drying fabric.

60. The method of claim 45, further comprising cleaning the permeable patterned surface of the patterned cylinder at a free surface of the patterned cylinder.

61. The method of claim 60, wherein the cleaning includes directing a cleaning medium through the permeable patterned surface away from the interior of the patterned cylinder in a radial direction of the patterned cylinder.

62. The method of claim 61, wherein the cleaning medium includes at least one of air, water, and a cleaning solution.

63. A method of making a fibrous sheet, the method comprising:

(a) forming a nascent web from an aqueous solution of papermaking fibers;

(b) applying the nascent web to an outer surface of a steam filled drum and dewatering the nascent web by moving the nascent web on the outer surface of the steam filled drum to form a dewatered web having a consistency from about thirty percent solids to about sixty percent solids;

(c) transferring the dewatered web from the outer surface of the steam filled drum to a patterned surface of a patterned cylinder in a molding zone, the molding zone being a nip defined between the outer surface of the steam filled drum and the patterned surface of the patterned cylinder, the patterned surface (i) being formed on the exterior of the patterned cylinder and (ii) having at least one of a plurality of recesses and a plurality of protuberances, such that papermaking fibers of the dewatered web are (i) redistributed on the patterned surface and (ii) shaped by at least one of the plurality of recesses and the plurality of protuberances of the patterned surface in the molding zone to form a molded paper web;

(d) transferring the molded paper web from the patterned surface of the patterned cylinder to a pick-up surface; and (e) drying the molded paper web in a drying section to form a fibrous sheet.

64. The method of claim 63, wherein the dewatered web has a consistency from about forty percent solids to about fifty-five percent solids.

65. The method of claim 63, wherein the dewatering further includes directing hot air from a hood against the nascent web.

66. The method of claim 63, further comprising:

(f) moving the outer surface of the steam filled drum at a drum speed; and (g) rotating the patterned surface of the patterned cylinder at a cylinder speed, the drum speed being faster than the cylinder speed.

67. The method of claim 66, wherein the creping ratio between the patterned cylinder and the pick-up surface is from about sixty percent to about one hundred fifteen percent.

68. The method of claim 63, further comprising applying a vacuum at a vacuum zone, the vacuum being applied to draw the molded web from the patterned surface of the patterned cylinder to the pick-up surface, the molded web being transferred from the patterned surface of the patterned cylinder to the pick-up surface in the vacuum zone.

69. The method of claim 68, wherein the pick-up surface comprises a fabric or a belt, and the vacuum is applied by a suction roll.

70. The method of claim 63, wherein the pick-up surface comprises a fabric or a belt.

71. The method of claim 63, wherein the molded web is transferred to the pick-up surface at a nip formed between the patterned surface and the pick-up surface.

72. The method of claim 63, further comprising:

(f) rotating the patterned surface of the patterned cylinder at a cylinder speed; and (g) moving the pick-up surface at a pick-up surface speed, the cylinder speed being faster than the pick-up surface speed.

73. The method of claim 63, wherein the drying section comprises a through-air dryer and the drying step includes drying the molded paper web using the through-air dryer.

74. The method of claim 73, wherein the drying section further comprises a through-air drying fabric, and the pick-up surface is the through-air drying fabric.

* * * * *